United States Patent [19]

Tabei

[11] Patent Number: 4,862,133

[45] Date of Patent: Aug. 29, 1989

[54] THERMAL SWITCH

[75] Inventor: Shigeru Tabei, Machida, Japan

[73] Assignee: Tobu Electric Co., Ltd., Tokyo, Japan

[21] Appl. No.: 238,003

[22] Filed: Aug. 29, 1988

[30] Foreign Application Priority Data

Mar. 29, 1988 [JP] Japan ..... 63-73188

[51] Int. Cl.[4] ..... H01H 61/02; H01H 71/16

[52] U.S. Cl. ..... 337/102; 337/365; 337/377

[58] Field of Search ..... 337/102–107, 337/377, 365; 338/333

[56] References Cited

U.S. PATENT DOCUMENTS

| | | | |
|---|---|---|---|
| 3,307,111 | 2/1967 | Braun | 338/333 |
| 3,495,150 | 2/1970 | Enemark | 337/107 |
| 4,039,992 | 8/1977 | Givler | 337/365 |

*Primary Examiner*—H. Broome

*Attorney, Agent, or Firm*—Jordan and Hamburg

[57] ABSTRACT

This invention provides a small-size thermal switch having a base formed of an electrically conductive plastic. The thermal switch is arranged such that, after a bimetallic element deflects in a reverse direction and opens the circuit of the thermal switch, the bimetallic element is self-held in such a reversely deflected state and the self-held state of the bimetallic element is maintained until an electrical power source is switched off. This invention further provides a thermal switch in which one surface of its movable-contact leaf spring is maintained in contact with the surface of its bimetallic element which is formed of a metal having the lower coefficient of expansion. Since the bimetallic element is sandwiched between the base and the movable contact, the stability of the bimetallic element in a recess of the base is improved.

16 Claims, 5 Drawing Sheets

THERMAL SWITCH

BACKGROUND OF THE INVENTION:

1. Field of the Invention:

The present invention relates generally to a thermal switch suitable for use in preventing overheat or an overcurrent from occurring in either a heat generating device such as a hair dryer or a dish dryer or a small-capacity electrical motor used in, for example, an electrical washing machine or an electrically-powered shutter. More specifically, the present invention relates to a small-size thermal switch in which, after a bimetallic element deflects in a reverse direction and opens the circuit of the thermal switch, the bimetallic element is self-held in such a reversely deflected state and the self-held state of the same is maintained until a predetermined time period has passed or until an electrical power source has been switched off. Incidentally, the term "thermal switch" used herein embraces a thermostat, an overcurrent protector or the like.

2. Description of the Related Art:

Japanese Patent Laid-open Nos. SHO 54-140977 and SHO 62-222529 disclose conventional types of thermal switch having a so-called self-holding function. The self-holding function is such that, after a bimetallic element deflects in a reverse direction and opens the circuit of the thermal switch, the bimetallic element continues to be heated and self-held in its reversely deflected state, the reversely deflected state of the bimetallic element being held until an electrical power source is switched off. Such a conventional type of thermal switch has a structure in which, when the bimetallic element deflects in the reverse direction and the contact is opened, a current flows in a resistance-type heat generating element so that the heated state of the bimetallic element is held by the heat generated by the resistance-type heat generating element.

However, the related art thermal switch having the above-described structure involves the following problems. Since it is necessary that an additional resistance-type heat generating element be connected between terminals, a complex structure is needed when compared with the structure of a normal type of thermal switch. As a result, the manufacturing process becomes complicated compared with that of thermal switches of the type which does not have a self-holding function. Furthermore, the positional relationship between the resistance-type heat generating element and the bimetallic element may hinder efficient transfer of heat from the resistance-type heat generating element to the bimetallic element.

Another type of thermal switch is known in which, in a normal state, the surface of its bimetallic element which consists of a metal having the higher coefficient of expansion is maintained in contact with a movable-contact leaf spring. In a case where such a thermal switch is incorporated in an automobile or the like, a significant magnitude of vibration may be applied to the thermal switch itself, with the result that the stability of the thermal switch is lowered to a remarkable extent.

SUMMARY OF THE INVENTION

It is, therefore, an object of the present invention to provide a thermal switch which can be easily manufactured and in which heat conduction to a bimetallic element is improved.

It is another object of the present invention to provide a thermal switch in which the stability of a bimetallic element within a recess formed in a base is improved.

To achieve the above and other objects, in accordance with the present invention, there is provided a thermal switch in which a bimetallic element which is disposed on a base deflects in a reverse direction to cause the movable contact of a movable-contact leaf spring to separate from a fixed contact, thereby cutting off the electrical connection between the movable contact and the fixed contact. In the present inventive thermal switch, the base on which are disposed a movable-contact terminal plate and a fixed-contact terminal plate is formed of an electrically conductive plastic, and the base itself is used as a heat generating element. After the bimetallic element has deflected in a reverse direction to cause its contact to open, the base itself generates heat and thus the bimetallic element is heated, so that the bimetallic element is held in such a reversely deflected state. In accordance with the present invention, an additional resistance-type heat generating element is not needed, and the bimetallic element can be positively heated since the base itself is used as a heat generating element.

The electrically conductive plastic for use in the present invention may be selected between a polyphenylene sulfide resin which contains a carbon and a phenolic resin which contains a carbon. From either resin, an electrically conductive plastic having a specific resistance of the order of $10^2$ to $10^8$ Ω-cm can be obtained by adjusting the carbon content. When the electrically conductive plastic thus obtained is molded into a base which has a cross-sectional area of 2 mm×6 mm and which is used in the present invention, the following resistance values are obtained.

In the case of a phenolic-type electrically conductive plastic having a specific resistance of $3\times10^3$ Ω-cm, the resistance of the obtained base ranges from 150 to 200 Ω.

In the case of a phenolic-type electrically conductive plastic having a specific resistance of $6\times10^3$ Ω-cm, the resistance of the obtained base ranges from 300 to 400 Ω.

In the case of a phenolic-type electrically conductive plastic having a specific resistance of $1\times10^7$ Ω-cm, the resistance of the obtained base ranges from 20,000 to 30,000 Ω.

In the case of a phenolic-type electrically conductive plastic having a specific resistance of $1\times10^7$ Ω-cm, the resistance of the obtained base ranges from 20,000 to 30,000 Ω.

In the case of a polyphenylene-sulfide-type electrically conductive plastic having a specific resistance of $5\times10^6$ Ω -cm, the resistance of the obtained base ranges from 18,000 to 25,000 Ω.

The above and other objects, features and advantages of the present invention will become apparent from the following description of preferred embodiments thereof, taken in conjunction with the accompanying drawings.

DESCRIPTION OF THE PREFERRED EMBODIMENTS

Preferred embodiments of a thermal switch according to the present invention will be described below with reference to the accompanying drawings.

Figure 1:
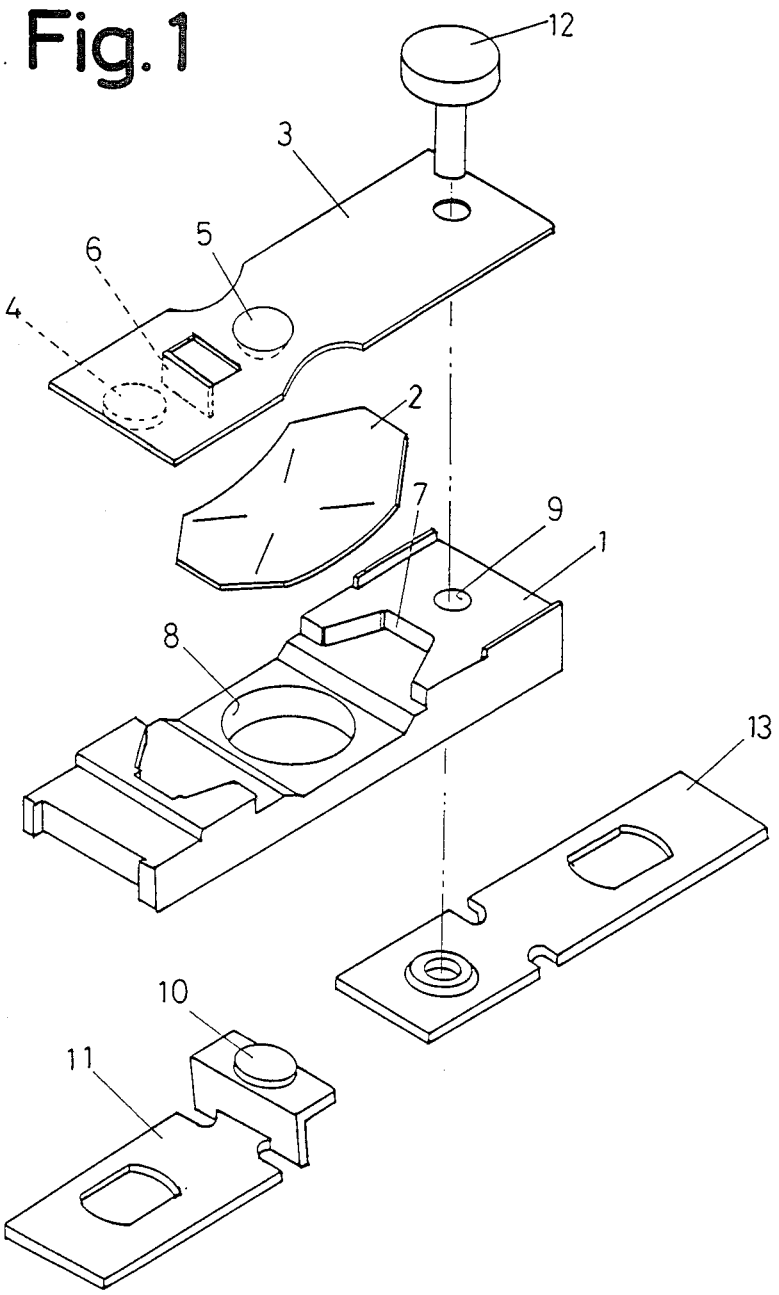
FIG. 1 is an exploded perspective view of one embodiment of a thermal switch according to the present invention.
Figure 2:
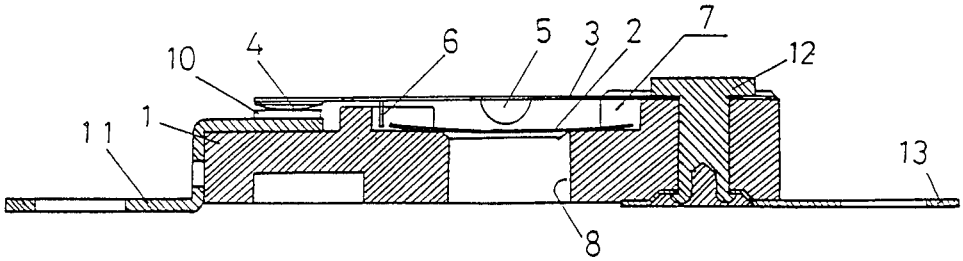
FIG. 2 is a cross-sectional view of the thermal switch of FIG. 1 in its assembled state.
Figure 3:
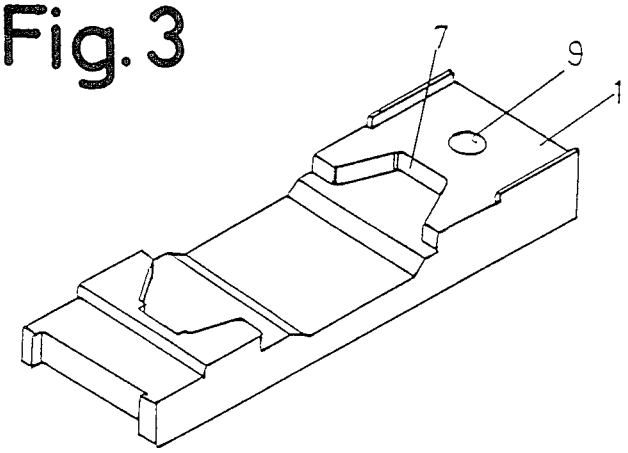
FIG. 3 is a perspective view showing another example of the base used in the thermal switch of FIG. 1.

Referring first to FIGS. 1 to 3 which illustrate a first embodiment of the present invention, a base formed of an electrically conductive plastic is denoted by reference numeral 1, and a bimetallic element 2 is disposed on the base 1. The bimetallic element 2 is a curved plate which is formed into an approximately hexagonal shape in plan view by a drawing process. The resistance of the electrically conductive plastic may be arbitrarily selected in accordance with the required amount of heat to be generated. In the illustrated example, the bimetallic element 2 is disposed directly on the base 1, but an insulator such as insulating paper may be interposed between the bimetallic element 2 and the base 1 as the case may be. A movable-contact leaf spring 3 has a movable contact 4 at its one end and a projection 5 at its intermediate narrow portion, and an engagement claw 6 is formed between the movable contact 4 and the projection 5.

A bimetallic-element accommodating recess 7 (hereinafter referred to simply as the "recess") in which the bimetallic element 2 is accommodated and held in position is formed in the middle portion of the base 1 at one side thereof. The recess 7 is formed into a shape which allows the bimetallic element 2 to be maintained in direct contact with the base 1 and which can engage with at least the four corners of the bimetallic element 2 so as not to allow the bimetallic element 2 to move in any horizontal directions. In the illustrated example, since the bimetallic element 2 has an approximately hexagonal shape, the recess 7 also has a similar hexagonal shape. The recess 7 is formed so that it may be larger in size than the bimetallic element 2 so as not to hinder the reverse deflection of the bimetallic element 2. Therefore, the bimetallic element 2 is accommodated in the recess 7 with a slight amount of play. A through-hole 8 is formed in the central portion of the recess 7 of the base 1. Since the portion of the base 1 which includes the through-hole 8 differs in cross-sectional area from the remaining portion, the amount of heat to be generated can be adjusted by selecting the diameter of the through-hole 8.

It is to be noted that the through-hole 8 may not be formed as shown in FIG. 3 if no abrupt rise in temperature is required in the vicinity of the bimetallic element 2.

A rivet hole 9 used for mounting the movable-contact leaf spring 3 is formed in the base 1 at one end thereof, while a fixed-contact terminal plate 11 having a fixed contact 10 is disposed at the other end. The movable-contact leaf spring 3 is firmly fixed to the base 1 by means of an electrically conductive rivet 12 and a movable-contact terminal plate 13 is likewise firmly fixed to the side of the base 1 opposite to the movable-contact leaf spring 3 by mean of the same rivet 12. In this manner, a positive electrical connection is established between the movable-contact leaf spring 3 and the movable-contact leaf plate 13.

Figure 4:
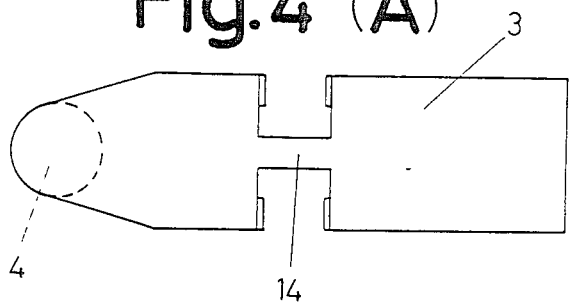
FIGS. 4 to 6 show examples of the movable-contact leaf spring used in the embodiment but having a heat generating portion which is reduced in width, parts (A) and (B) of each of the figures being a plan view and a front view, respectively.
Figure 4:
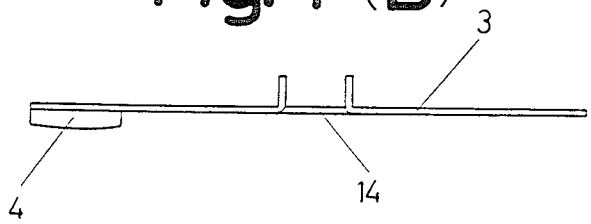
Figure 5:
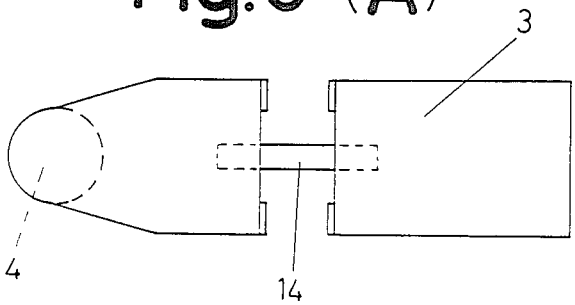
Figure 5:
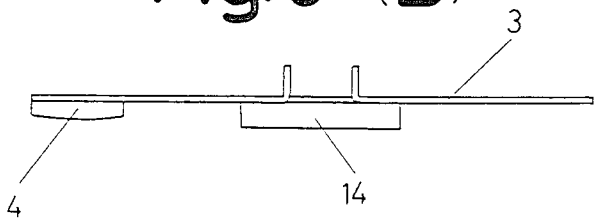
Figure 6:
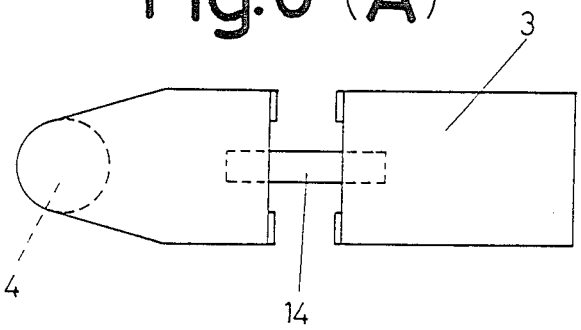
Figure 6:
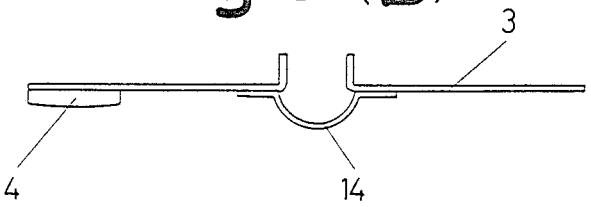

As occasion demands, the movable-contact leaf spring 3 may be formed of a material having large electrical resistance. In this case, the bimetallic element 2 can be activated by heat generated by an overcurrent rather than variations in ambient temperature. In other words, the present thermal switch having such a construction can be used as a thermostat or an overcurrent protector. In this case, it is effective that a heat generating portion 14 of the movable-contact leaf spring 3 is formed into a narrow shape as shown in part (A) of FIG. 4 through FIG. 6.

Figure 9:
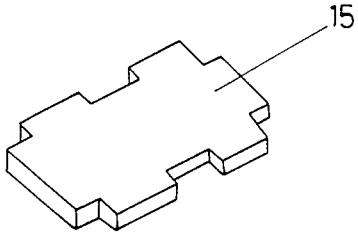
FIG. 9 is a perspective view of a reinforcement member for use in the embodiment.
Figure 10:
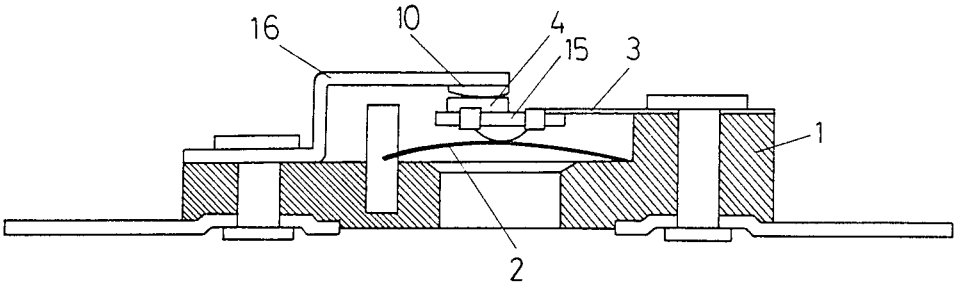
FIG. 10 is a cross-sectional view illustrating the example of usage of the reinforcement member shown in FIG. 9.
Figure 7:
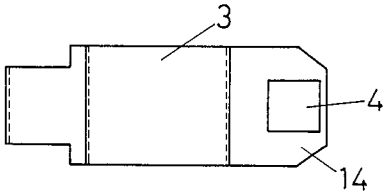
FIGS. 7 to 8 are, respectively, plan views showing other examples of the movable-contact leaf spring used in the embodiment.
Figure 8:
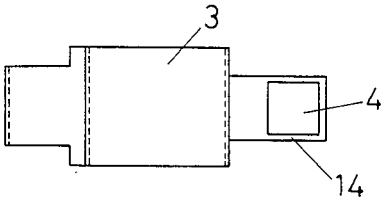

It is to be noted that, if it is desired, as will be described later, to bring the movable contact 4 into contact with the bimetallic element 2, this movable contact 4 is utilized as the heat generating portion 14 to adjust the amperage of a current as shown in each of FIGS. 7 and 8. In a case where the heat generating portion 14 is formed into a narrow shape, a reinforcement member 15 may be added as shown in FIGS. 9 and 10 in order to reinforce the heat generating portion 14.

A second embodiment will be described below with reference to FIGS. 11 and 12 in which like reference numerals are used to denote the like or corresponding portions used in the first embodiment.

In the second embodiment, the bimetallic element 2 is disposed such that, in the non-deformed state of the bimetallic element 2, its surface which consists of a metal having the lower coefficient of expansion is maintained in contact with the movable-contact leaf spring 3, while the other surface which consists of a metal having the higher coefficient of expansion opposes the base 1.

As illustrated, a fixed-contact lever 16 is mounted to the base 1, and the fixed contact of the fixed-contact lever 16 is denoted by reference numeral 10. The movable-contact leaf spring 3 is likewise mounted to the base 1, and the movable contact of the movable-contact leaf spring 3 is denoted by reference numeral 4. The fixed-contact lever 16 and the movable-contact lever 3 are arranged such that, as shown in FIG. 12, the fixed contact 10 of the fixed-contact lever 16 is located above the movable contact 4 of the movable-contact leaf spring 3, and the movable-contact leaf spring 3 is urged downwardly. The bimetallic element 2 is disposed below the movable-contact leaf spring 3, and is formed into a curved shape. This bimetallic element 2 is disposed on the base 1 in such a manner that its surface which consists of a metal having the lower coefficient of expansion faces up, that is, opposes the movable-contact leaf spring 3. In a state wherein the bimetallic element 2 is not deformed by heat, that is, in a normal state, the movable contact 4 of the movable-contact leaf spring 3 is maintained in contact with the bimetallic element 2 substantially in the center thereof. In this arrangement, the fixed contact 10 applies a pressure to the movable contact 4 as well as the bimetallic element 2 in contact with the movable-contact leaf spring 3, whereby a high contact pressure can be maintained. The portion of the movable-contact leaf spring 3 which has a certain area is maintained in contact with the bimetallic element 2 in a flat manner so that heat generated by a current can be efficiently transferred from the movable-contact leaf spring 3 to the bimetallic element 2.

The following is a description of the operations of the respective embodiments having the above-described constructions.

When the thermal switch according to the present invention is incorporated in an apparatus, an electrical wire is connected to each of the fixed-contact terminal 11 and the movable-contact terminal 13, and a current is supplied to the thermal switch via the electrical wire. In a normal state, the current flows through the movable-contact terminal 13, the movable-contact leaf spring 3, the movable contact 4, the fixed contact 10 and the fixed-contact terminal 11 in that order. Since the base 1 has large resistance although it is electrically conductive, in a normal state, a current hardly flows in the base 1 and the base 1 does not generate heat. When the temperature of the bimetallic element 2 reaches a set temperature, the bimetallic element 2 operates to separate the movable contact 4 from the fixed contact 10. When both contacts 4 and 10 are separated from each other, a current starts to flow in the base 1. Since the base 1 is formed of an electrically conductive plastic having relatively large resistance, the base 1 generates heat and thus the bimetallic element 2 is heated. Accordingly, the bimetallic element 2 is held in its reversely deflected state and both contacts 4 and 10 are kept separate from each other. Since the base 1 has electrical conductivity but large resistance, the current passing through the movable-contact terminal 13 hardly flows into the fixed-contact terminal 10, and the function of the apparatus is held in a substantially suspended state. In this state, if an electrical power source (not shown) is switched off, the heating of the base 1 is stopped and the bimetallic element 2 is reset to its normal state. Thus, both contacts 4 and 10 are connected to each other and the operation of the apparatus is again enabled.

Figure 11:
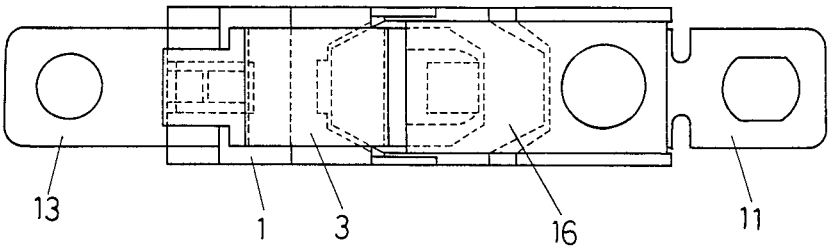
FIGS. 11 and 12 are, respectively, a plan view and a cross-sectional view illustrating another embodiment in which, in the non-deformed state of a bimetallic element, its surface which consists of a metal having the lower coefficient of expansion is maintained in contact with a movable-contact leaf spring, while the other surface which consists of a metal having the higher coefficient of expansion opposes a base.

In the case of the second embodiment shown in FIG. 11, if the movable-contact leaf spring 3 is heated by an overcurrent while in use, the bimetallic element 2 is deformed by heating in the direction opposite to that of its deformation in the normal state. Accordingly, as the bimetallic element 2 is deformed, the movable-contact leaf spring 3 which is urged downwardly is moved in the downward direction, and the movable contact 4 of the movable-contact leaf spring 3 separates from the fixed contact 10 of the fixed-contact lever 16. On the other hand, if the bimetallic element 2 returns to its original form, the movable-contact leaf spring 3 is lifted up by the bimetallic element 2 and the movable contact 4 of the movable-contact leaf spring 3 is brought into contact with the fixed contact 10 of the fixed-contact lever 18. The other operations of the second embodiment are similar to those of the first embodiment described above.

As described above, the present invention succeeds in providing an improved thermal switch, that is, an improved thermostat or an improved overcurrent protector in which a bimetallic element which is disposed on a base deflects in a reverse direction to cause the movable contact of a movable-contact leaf spring to separate from a fixed contact, thereby cutting off the electrical connection between the movable contact and the fixed contact. In the prevent inventive thermal switch, the base on which are disposed the movable-contact terminal plate and the fixed-contact terminal plate is formed of an electrically conductive plastic. Therefore, the present invention provides the following great advantages. First, the reversely deflected state of the bimetallic element can be held by the heat generated by the base. Second, since no additional resistance-type heat generating element is needed, self-holding type bimetallic elements can be readily manufactured. Third, since the heat conductivity of the base with respect to the bimetallic element is improved, the bimetallic element can be positively self-held in its reversely deflected state.

Figure 12:
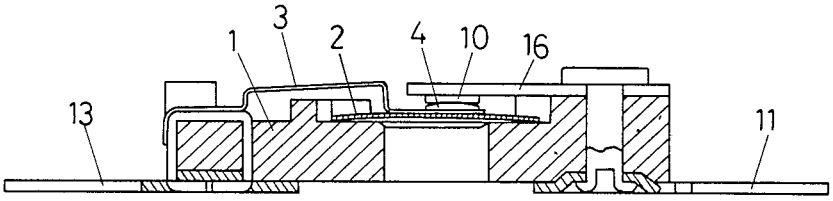

In each of the structures shown in FIGS. 10, 11 and 12, the bimetallic element is disposed such that, in its non-deformed state, the surface which consists of a metal having the lower coefficient of expansion is maintained in contact with the movable-contact leaf spring, while the other surface which consists of a metal having the higher coefficient of expansion opposes the base. Therefore, the lower surface of the bimetallic element is pressed against the base, while the upper surface is pressed against the movable contact and the fixed contact, whereby the position of the bimetallic element is normally fixed. Accordingly, the stability of the bimetallic element can be maintained even if vibration occurs, and it is possible to positively bring the movable-contact leaf spring into contact with the bimetallic element and hence to positively transfer heat generated by an overcurrent.

What is claimed is:

1. A thermal switch comprising a base, a fixed contact means and a movable contact means mounted on said base, a bimetallic element disposed on said base and operable upon being heated to deflect and to cause said movable contact means to be out of contact with said fixed contact means and to thereby dispose the switch in an open state, said switch having a closed state in which said movable contact means is biased into contact with said fixed contact means and current flows along a current path which includes said movable contact means and said fixed contact means, said base being connected electrically in parallel with said current path, said base being made of an electrically conductive plastic material having a resistance such that said base does not generate heat when the switch is in said closed state, said base being operable to generate heat when said switch is in said open state to maintain said bimetallic strip in said deflected state.

2. A thermal switch according to claim 1, wherein said movable contact means comprises a leaf spring mounted on said base and a movable contact element mounted on said leaf spring.

3. A thermal switch according to claim 2, wherein said movable contact means further comprises a terminal element mounted on said base and electrically connected to said leaf spring.

4. A thermal switch according to claim 1, wherein said fixed contact means comprises a fixed contact element mounted on said base and a terminal element mounted on said base and electrically connected to said fixed contact element.

5. A thermal switch according to claim 1, wherein said bimetallic element, upon being heated to deflect, engages said movable contact means to cause the latter to be out of contact with said fixed contact means.

6. A thermal switch according to claim 1, wherein said bimetallic element, upon being heated to deflect, disengages from said movable contact means to allow the latter to be out of contact with said fixed contact means.

7. A thermal switch according to claim 1, wherein said movable contact means comprises a leaf spring having a contact element on one side thereof which contacts said fixed contact means when the switch is in said closed state, said fixed contact means and said bimetallic element being disposed on said one side of said leaf spring.

8. A thermal switch according to claim 1, wherein said movable contact means comprises a leaf spring having a contact element on one side thereof which contacts said fixed contact means when the switch is in said closed state, said bimetallic element being disposed on said one side of said leaf spring, said fixed contact means being disposed on the opposite side of said leaf spring.

9. A thermal switch according to claim 8, wherein said leaf spring with its contact element is disposed to be in pressurized contact with said fixed contact means and said bimetallic element.

10. A thermal switch according to claim 8, wherein said bimetallic element has a central portion disposed to be in biasing contact with said leaf spring when the switch is in its closed state.

11. A thermal switch according to claim 1, wherein said movable contact means comprises an elongated leaf spring which has a heat-generating portion, said heat-generating portion having a cross-sectional area less than the cross-sectional area of the remaining portion of said leaf spring.

12. A thermal switch according to claim 11, further comprising a reinforcing member mounted on said heat-generating portion of said leaf spring.

13. A thermal switch according to claim 1, wherein said base has a recess for receiving and accommodating said bimetallic element.

14. A thermal switch according to claim 13, wherein said base has a base section underlying said recess, and a through hole in said base section.

15. A thermal switch according to claim 13, wherein said base has a cross-sectional area which varies over the area in which said through hole is disposed.

16. A thermal switch comprising a base, a fixed contact means having a fixed contact element and a first terminal mounted on said base, a movable contact means being a movable contact element, a leaf spring, and a second terminal mounted on said base, a bimetallic element disposed on said base and operable upon being heated to deflect and to cause said movable contact means to be out of contact with said fixed contact means and thereby dispose the switch in an open state, said switch having a closed state in which said movable contact means is biased by said leaf spring into contact with said fixed contact means and current flows along a current path which includes said second terminal, said leaf spring, said movable contact element, said fixed contact element and said first terminal, said base being connected electrically in parallel with said current path, said base being made of an electrically conductive plastic material having a resistance such that said base does not generate heat when the switch is in said closed state, said base being operable to generate heat when said switch is in said open state to maintain said bimetallic strip in said deflected state.

* * * * *